United States Patent [19]

Mattsson

[11] Patent Number: 4,602,720

[45] Date of Patent: Jul. 29, 1986

[54] LOCKING BAR FOR PIVOTED DOORS

[76] Inventor: Karl-Axel Mattsson, Hallenbergsvagen 55, 443 03 Stenkullen, Sweden

[21] Appl. No.: 798,693

[22] PCT Filed: Feb. 28, 1985

[86] PCT No.: PCT/SE85/00095

§ 371 Date: Oct. 22, 1985

§ 102(e) Date: Oct. 22, 1985

[87] PCT Pub. No.: WO85/03921

PCT Pub. Date: Sep. 12, 1985

[30] Foreign Application Priority Data

Feb. 29, 1984 [SE] Sweden ..... 8401107

[51] Int. Cl.[4] ..... B65D 45/00

[52] U.S. Cl. ..... 220/315; 292/259 R

[58] Field of Search ..... 220/315; 292/359 R, 292/148, DIG. 21

[56] References Cited

U.S. PATENT DOCUMENTS

| | | | |
|---|---|---|---|
| 1,176,407 | 3/1916 | Shirey | 292/259 |
| 3,830,537 | 8/1974 | Brindle | 292/259 |
| 4,120,415 | 10/1978 | Hopkins et al. | 220/315 |

*Primary Examiner*—George T. Hall

*Attorney, Agent, or Firm*—Balogh, Osann, Kramer, Dvorak, Genova & Traub

[57] ABSTRACT

An arrangement for rendering difficult the unauthorized opening of door etc. arrangements on containers which have corner fittings with openings of a non-circular shape. The arrangement enables the security against unauthorized opening of the doors etc. on containers to be increased, using simple means, and it is also possible to remove the arrangements from the said containers when they are not required for the said purpose. A bar or a similar arrangement for preventing opening, which can be fixed across an end wall or another side wall or a roof with a pivotable door arrangement on it, has two locking devices disposed at a mutual distance from each other and adapted to the openings in the said corner fittings, of which at least one locking device can be influenced by a manual influencing member which can be locked to the said bar, the said locking devices being designed so that when the bar and the influencing member are held in a connecting position they can be inserted in the complementary openings in the corner fittings on the container in question, and when in a blocking position they are forcibly retained in the said openings in order to hold the locked bar in place to prevent the container in question from being opened.

14 Claims, 6 Drawing Figures

Figures 1, 2, 3:
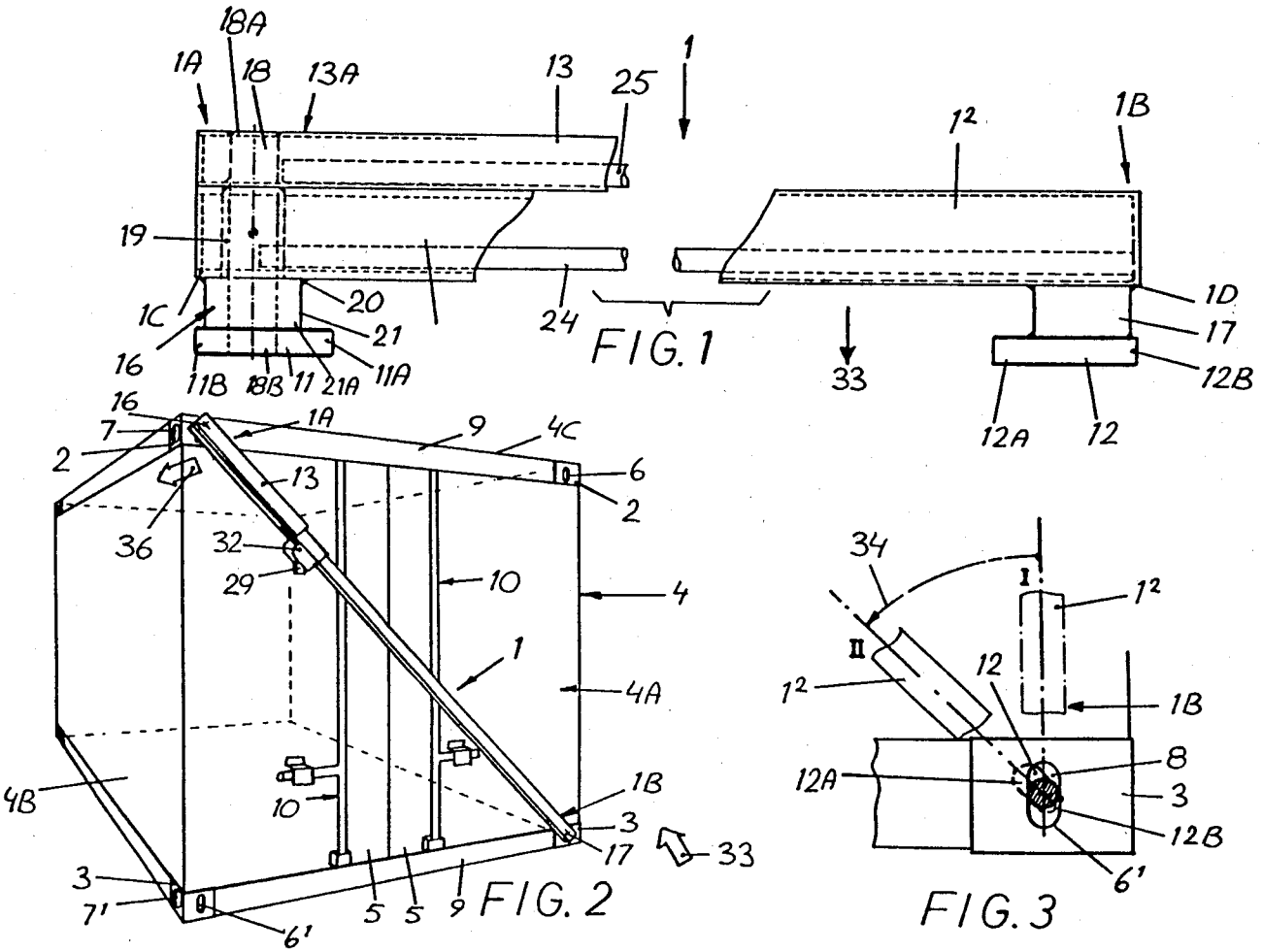

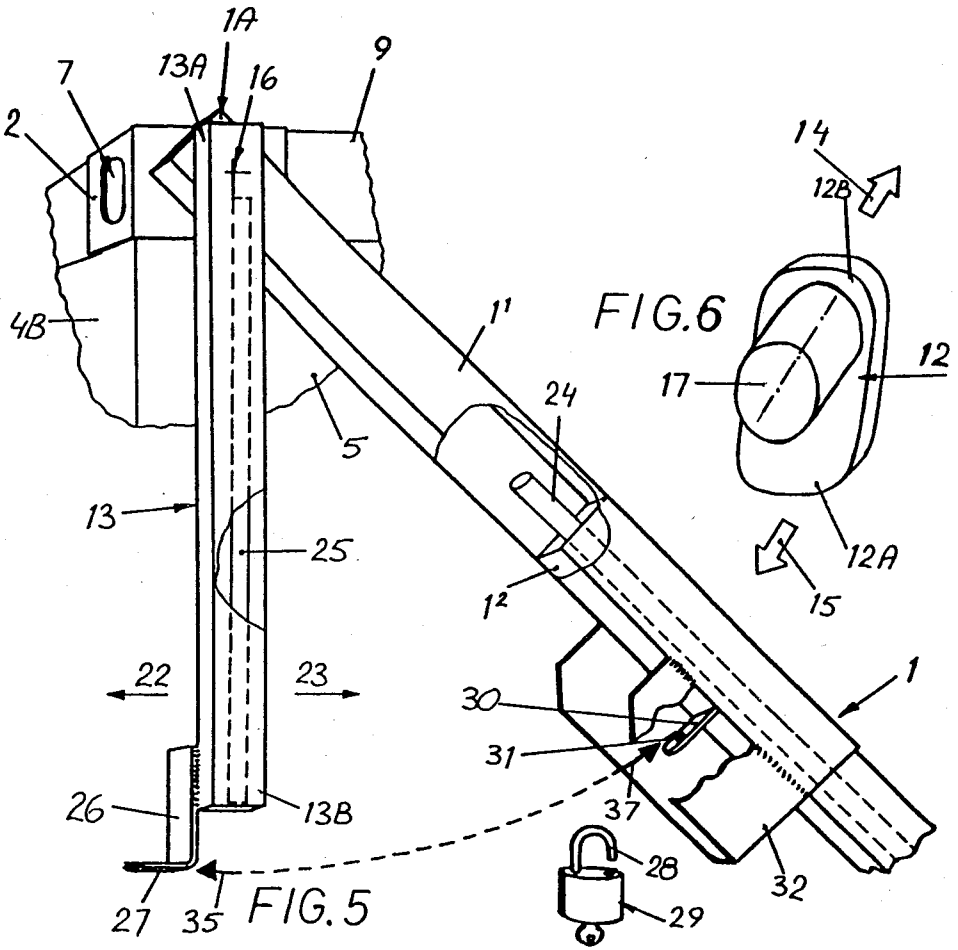
FIG. 6
FIG. 5
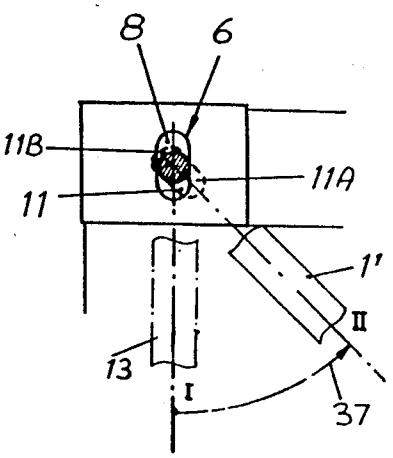
FIG. 4

LOCKING BAR FOR PIVOTED DOORS

The present invention relates to an arrangement for rendering more difficult the unauthorised opening of the door mechanism on containers which have corner fittings with openings of a non-circular shape.

It is already known to provide increased security for containers of the above type by permanently fixing a pivotable cross-bar on the outside thereof by welding or bolting; this is designed to be pivoted upon opening so that it co-acts with a hooking device for locking it to the latter across the boundary opening edge of the actual door arrangement. In this case, when fixing the said cross-bar, the said containers have to be acted upon so that their outer surface is deformed and the cross-bars have to accompany the containers whenever they are being transported, even if there are no goods packed inside them.

The main object of the present invention is primarily to provide an arrangement of the above-mentioned type which solves the said problems, and which affords considerably increased security against breaking-in. The said object is achieved by means of an arrangement according to the present invention which is substantially characterised in that a bar-type arrangement or a similar elongated arrangement which prevents opening, which can be fixed across an end wall or another side wall or a roof with a pivotable door arrangement on it, has two locking devices disposed at a mutual distance from each other and adapted to openings in the said corner fittings, of which at least one locking device can be influenced by a manually operated influencing member which can be locked to the said bar, the said locking devices being designed so that when the bar and the influencing member are held in a connecting position they can be inserted in the complementary openings in the corner fittings on the container in question, and in a blocking position they are forcibly retained in the said openings in order to hold the locked bar in place to prevent the container in question from being opened.

The invention is described below by way of a preferred embodiment example, with reference to the accompanying drawings, on which FIG. 1 shows an arrangement to prevent opening, designed according to the present invention, in a partially cut-away view, FIG. 2 shows schematically a container with an arrangement according to the invention held in a blocking position, FIG. 3 shows a partial view of a lower corner fitting with the arrangement held in a connecting position and a blocking position, respectively, FIG. 4 shows a partial view of an upper corner fitting with the arrangement held in a connecting position and a blocking position, respectively, FIG. 5 shows the upper part of the arrangement with an influencing member held in a pivoted-out, connecting position, and FIG. 6 shows a perspective view of a fixed locking device appertaining to the arrangement.

According to the invention a bar-like arrangement 1 with a considerably longitudinal extent, or a similar arrangement for preventing opening, is intended to be releasably connected to an upper and a lower corner fitting 2 and 3 respectively on a container 4, with a view to rendering it more difficult to effect unauthorised opening of the locking arrangements attached to the pivotable doors 5 or other openings disposed in the end walls 4A or in the long sides 4B or in the roof 4C of the container, in that it extends across the said locking arrangements. Connection is made possible by making use of the corner fitting openings 6, $6^1$ and 7, $7^1$ respectively, which are located in the actual corner fittings 2, 3 and have a non-circular shape, with an accommodating space 8 inside them.

In the present example two pivotable doors 5 are shown; these are located in a short end wall 4A of a container and can be locked to the frame 9 of the container by means of known locking devices 10; the said arrangement 1 can be attached to the said corner fitting openings 6, $6^1$; 7, $7^1$ in that two locking devices 11 and 12 respectively, adapted to the said corner fitting openings 6, $6^1$ and 7, $7^1$ respectively, can be inserted through their respective corner fitting openings 6 and $6^1$ respectively which are disposed diagonally opposite each other, as shown on the drawing in FIG. 2, so that the preferably bar-like arrangement 1 extends diagonally across the said doors 5, etc. At least one of the two said locking devices 11, 12, namely, the locking device 11, is mounted movably and can be influenced by a manually operated influencing member 13 which can be locked to the said bar arrangement 1.

The bar 1 is expediently formed of a preferably telescopic hollow beam $1^1$, $1^2$, which has at its free end 1A the said preferably similarly hollow beam-type, lever arm-like influencing member 13; the beam $1^1$, $1^2$ and the member 13 respectively are expediently connected via their free outer ends 1A, 1B and 13A, 13B respectively.

The said locking devices 11, 12 are formed by hooks 11, 12 which have a non-circular circumferential shape, for example as shown in FIG. 6, to allow them to be inserted in the direction of the arrows 14, 15, in and out of their respective complementary corner fitting openings 6 and $6^1$ respectively, and to be supported by their respective mountings 16, 17 which are connected to the said bar $1^1$, $1^2$ and the width of which corresponds substantially to the width of the said complementary corner fitting openings 6, $6^1$. The mounting 16 for the locking hook 11, which is located at the end 1A of the bar $1^1$, $1^2$ where the influencing member 13 is mounted, is formed, for example, by a steel spindle 18 which is rigidly connected by one end 18A, for example by welding, to one outer end 13A of the influencing member 13, and is accommodated in a bearing bush 19 connected to the bar $1^1$, $1^2$. The said movable locking device 11 is rigidly connected, for example by welding, to the other end 18B of the spindle which extends through a primary bearing bush 21, similarly connected by a welded seam 20. The width of the said primary bearing bush 21 accordingly corresponds substantially to the width of the said mounting 16, and pivoting to the influencing member 13 in the direction of the arrows 22 or 23 means that a rotary movement is transmitted via the said spindle 18 to the locking device 11 to bring about rotation of the latter by the desired amount in the vicinity of the free end 21A of the primary bearing bush.

The mounting 17 for the remaining locking device 12 consits of a hollow or solid body which is fixed, for example by welding, to the said locking device 12 and the bar $1^1$, $1^2$ respectively, so that the mounting 17 extends in the same direction as the mounting 16, preferably out at right-angles from the bar $1^1$, $1^2$.

The locking device hooks 11, 12 expediently have an elongated hook part 11A and 12A respectively which extends out away from the said mountings 16, 17, and there is preferably also a shorter hook part 11B and 12B respectively, which extends out from the mountings 16, 17 in the opposite direction from that of the elongated hook parts 11A and 12A respectively.

Inside them the said hollow bar $1^1$, $1^2$ and the influencing member 13 each have movable reinforcement, which is preferably formed by loosely accommodated rods 24 and 25 respectively, made of metal material and extending through the said bar and member respectively.

At its outer end 13B the influencing member 13 has a preferably hook-shaped connecting piece 26 which can be provided with an opening 27 designed to take the locking loop 28 of a padlock 29 which is well-known for securing purposes, or some other suitable locking device. The said connecting piece 26 is designed so that it can be connected to a preferably tongue-shaped locking projection 30 connected to the bar $1^1$, $1^2$, and which also has an opening 31 designed to receive the said locking loop 28.

The said locking projection 30 is surrounded by a shield 32 which extends along three sides of the projection 30, to protect it from interference.

The functioning of an arrangement 1 as described above is as follows:

The arrangement is raised up into a vertical connecting position, indicated by I in FIG. 3 on the drawing, so that the locking hook 12 which is preferably arranged with its elongated part 12A extending along the bar $1^1$, $1^2$ in the direction of the bar end 1A can be inserted in the direction of the arrow 33 through the opening $6^1$ which is located in one lower corner fitting 3 on a container, and accommodated in the space 8 inside the opening $6^1$. After this, the arrangement 1 is pivoted in the direction of the arrow 34 so that the bar $1^1$, $1^2$ extends diagonally across the container 4 between the lower and upper corner fittings thereof respectively, as shown schematically in FIGS. 2, 3 and 4, into a so-called blocking position, designated II, the influencing member 13 being held pivoted out in the direction of the arrow 35 into a connecting position I so that the movable locking hook 11, which is designed to be rotated until it is at an angle of approximately 45° relative to the bar $1^1$, can be inserted in the direction of the arrow 36 through the complementary opening 6 in one of the upper corner fittings 2 on the container, and accommodated in the space 8 inside the said opening 6. The member 13 is then rotated in the direction of the arrow 37 so that the locking connecting piece 26 on it comes into a position adjacent to the locking projection 30, whereupon these can be locked securely to each other by means of a padlock 29, etc., protected from outside interference inside the shield 32. In the said blocking position II with the member 13 designed to extend along the bar $1^1$, $1^2$ the locking hook 11 is expediently designed to extend with its longitudinally extending part 11A along the bar $1^1$, $1^2$ in the direction of the 1B of the bar, and similarly the locking hook 12 is forcibly retained in the accommodating space 8 in the respective corner fiting 2 or 3 which is being used, thus preventing the arrangement from being removed from the container 4. In the said blocking position the cross-bar arrangement 1 which extends outside the actual door locking device 10 on the container 4 renders more difficult the unauthorised opening of the doors 5, etc. from the outside of the container.

Due to the fact that the mountings 16 and 17 for the respective locking hooks 11 and 12 are located at a distance from the ends 1A and 1B of the bar such that the locking hook parts 11B and 12B respectively which project to a lesser extent from the mountings 16, 17, and the parts 1C and 1D respectively located beyond the said mountings at the respectively ends 1A, 1B of the bar engage round part of the corner fittings 2, 3, the arrangement 1 is prevented from being released by pulling it at right-angles to the container and breaking out the outer bar ends 1A, 1B.

The arrangement 1 is released by carrying out the above steps in the reverse order.

When released, the arrangement can be stored away from the actual container 4 when it is not necessary for the latter to be locked.

The invention is not limited to the arrangement described above and shown on the drawings, but can be modified within the framework of the Patent Claims without exceeding the scope of the invention. For example, it is possible to provide joints at a number of the said bar ends with a view to allowing the bar to be pivoted relative to a locking device.

I claim:

1. An arrangement for rendering difficult the unauthorised opening of the door etc. arrangements (5) on containers (4) which have corner fittings (2, 3) with openings (6, $6^1$; 7, $7^1$) of a non-circular shape, characterised in that a bar-type arrangement (1) or a similar elongated arrangement which prevents opening, which can be fixed across an end wall (4A) or another side wall (4B) or a roof (4C) with a pivotable door arrangement (5) on it, has two locking devices (11,12) disposed at a mutual distance from each other and adapted to the openings (6, $6^1$; 7, $7^1$) in the said corner fittings, of which at least one locking device (11) can be influenced by a manually operated influencing member (13) which can be locked to the said bar (1), the said locking devices (11, 12) being designed so that when the bar (1) and the influencing member (13) are held in a connecting position (I) they can be inserted in the complementary openings (6, $6^1$) in the corner fittings on the container (4) in question, and when in a blocking position (II) they are forcibly retained in the said openings (6, $6^1$) in order to hold the locked bar in place to prevent the container (4) in question from being opened.

2. An arrangement according to patent claim 1, characterised in that the bar (1) is formed by a preferably telescopic hollow beam ($1^1$, $1^2$) which bears on one (1A) of its free ends the said hollow influencing member (13) which is like a lever arm.

3. An arrangement according to patent claim 2, characterised in that inside the said hollow bar ($1^1$, $1^2$) and the influencing member (13) there is reinforcement which extends along them and is movable through them.

4. An arrangement according to patent claim 2, characterised in that at one end (13B) of the influencing member (13) there is a preferably hook-shaped connecting piece (26) which can be locked, for example by means of a padlock (29), to a preferably tongue-shaped locking projection (30) connected to the bar (1).

5. An arrangement according to patent claim 4, characterised in that the said locking projection (30) is surrounded by a shield (32) extending along three sides thereof, to protect it from interference.

6. An arrangement according to patent claim 2, characterised in that the said locking devices (11, 12) are formed by books (11, 12) with a non-circular circumferential shape, connected to the bar (1) via spindles (18, 17).

7. An arrangement according to patent claim 6, characterised in that the said hooks (11, 12) are designed to extend along the bar (1) when it is held locked in the said blocking position (II).

8. An arrangement according to patent claim 2, characterised in that the said locking device hook (11) which can be influenced by the influencing member (13) is connected to the said member (13) via a rotatable spindle (18) which is mounted on one end (1A) of the bar.

9. An arrangement according to patent claim 8, characterised in that the rotatable spindle (18) is located at a distance from the said end (1A) of the bar such that a projecting bar part (1C) is formed at the said end (1A) of the bar, and is designed to co-act with part of an actual container (4) when the bar (1) is effective.

10. An arrangement according to claim 3, characterized in that at one end of the influencing member there is a preferably hook-shaped connecting piece which can be locked, for example by means of a padlock, to a preferably tongue-snaped locking projection connected to the bar.

11. An arrangement according to claim 3, characterized in that said locking devices are formed by hooks with a non-circular circumferential shape, connected to the bar via spindles.

12. An arrangement according to claim 4, characterized in that the said locking devices are formed by hooks with a non-circular circumferential shape, connected to the bar via spindles.

13. An arrangement according to claim 5, characterized in that said locking devices are formed by hooks with a non-circular circumferential shape, connected to the bar via spindles.

14. An arrangement according to claim 7, characterized in that the said locking device hook which can be influenced by the influencing member is connected to the said member via a rotatable spindle which is mounted on one end of the bar.

* * * * *